US008368317B2

(12) United States Patent
Man

(10) Patent No.: US 8,368,317 B2
(45) Date of Patent: Feb. 5, 2013

(54) FLASHLIGHT WITH MOMENTARY FUNCTION AND MULTIPLE LIGHTING MODES

(75) Inventor: Shiu-Fai Stephen Man, N.T. (HK)

(73) Assignee: Kaper Industrial Limited, N.T. (HK)

( * ) Notice: Subject to any disclaimer, the term of this patent is extended or adjusted under 35 U.S.C. 154(b) by 229 days.

(21) Appl. No.: 12/977,071

(22) Filed: Dec. 23, 2010

(65) Prior Publication Data

US 2012/0161670 A1 Jun. 28, 2012

(51) Int. Cl.
*H05B 41/16* (2006.01)

(52) U.S. Cl. ..... 315/247; 315/185 S; 315/291; 315/307; 315/224

(58) Field of Classification Search ..... 315/247, 315/224, 225, 246, 307–311, 297, 291
See application file for complete search history.

(56) References Cited

U.S. PATENT DOCUMENTS 6,819,060 B2 * 11/2004 Readio et al. ..... 315/291
2002/0153780 A1 * 10/2002 Wolff ..... 307/116

* cited by examiner

*Primary Examiner* — Tuyet Thi Vo

(57) ABSTRACT

A flashlight with momentary function and multiple lighting modes wherein a mechanical switch is activated by a push-button so that each depression of the pushbutton causes the switch to cycle through a first state, a second state and a third state sequentially. When the switch is in the first state or the second state, it is electrically connected to the respective port of the integrated circuit and the integrated circuit drives the light source to operate in the respective lighting mode; when the switch is in the third state, it is electrically disconnected from the integrated circuit and the integrated circuit drives the light source to operate in a third lighting mode. When the integrated circuit detects that the switch is disconnected from the integrated circuit after a state which corresponds to the OFF mode and is therefore transitioning to a subsequent state, it drives the light source to operate in the lighting mode of the subsequent state.

5 Claims, 1 Drawing Sheet

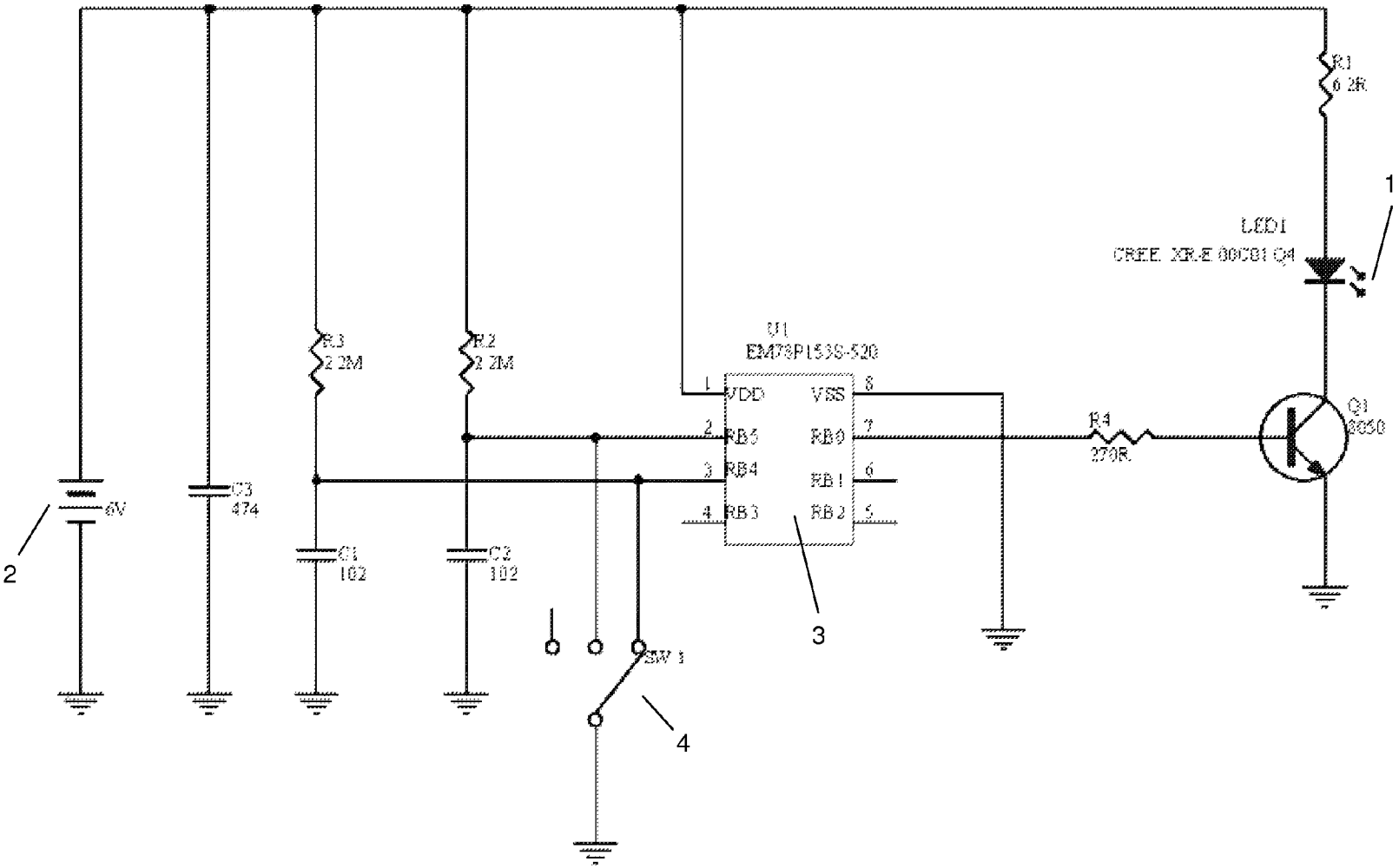
1
R1
0.2R
LED1
CREE XRE 00C81 C4
Q1
R4
270R
U1
EM78P153S-S20
VDD
VSS
RB0
RB1
RB2
RB3
RB4
RB5
3
SW 1
4
R2
2.2M
C2
102
R3
2.2M
C1
102
C3
474
6V
2

FLASHLIGHT WITH MOMENTARY FUNCTION AND MULTIPLE LIGHTING MODES

BACKGROUND OF THE INVENTION

The present invention relates to a flashlight and more particularly pertains to a flashlight with momentary function and multiple lighting modes.

Flashlights are commonly used for providing lighting for personal, domestic, commercial, industrial and even law enforcement use. At home, flashlights are not only useful for locating articles in dark areas such as underneath the bed, but also essential for providing emergency lighting when there is an electricity failure. When camping in the countryside, flashlights are indispensable not only for providing lighting at night, but for signaling purposes as well. Commercially, flashlights are indispensable tools for some industries such as plumbing and so forth. For policemen and law enforcers, flashlights are also very important when carrying out law enforcement operations at night.

Some flashlights are equipped with a pushbutton for actuating a mechanical clicker switch mechanism that switches the light on with a first "click" and off with a second "click". The clicker switch mechanism is popular among users as it provides tactile feedback. Some other flashlights are provided with a momentary switch to facilitate intermittent lighting. The flashlight is switched on when the user exerts pressure on a pushbutton to activate the switch, but once the pressure is released the light is switched off. Some flashlights offer on/off switching only yet some provide multiple lighting modes. Users who require high flexibility and convenience in switching the light on and off usually prefer flashlights operable by momentary switch, yet such flashlights often do not support multiple lighting modes.

BRIEF SUMMARY OF THE INVENTION

In view of the aforesaid disadvantages now present in the prior art, the object of the present invention is to provide a flashlight with momentary function and multiple lighting modes.

To attain this, the present invention comprises a light source, a power supply, an integrated circuit and a mechanical switch. The integrated circuit electrically connects with the power supply and the light source. The mechanical switch cycles through a plurality of states sequentially and the plurality of states sequentially comprises a plurality of first states and a second state. Each of the plurality of first states is associated with a port of the integrated circuit and a lighting mode. When the switch is in any of the plurality of first states, it is electrically connected to the port of the integrated circuit associated with the first state and the integrated circuit drives the light source to operate in a lighting mode associated with the first state. When the switch is in the second state, it is electrically disconnected from the integrated circuit and the integrated circuit drives the light source to operate in a lighting mode associated with the second state. When the integrated circuit detects that the switch is disconnected from the integrated circuit after any of the plurality of first states and is therefore transitioning to a subsequent first state, it drives the light source to operate in the lighting mode associated with the subsequent first state. When the switch transitions from the second state back to the first of the first states, no difference is caused to the integrated circuit as the switch is disconnected from the integrated circuit in the second state and so the integrated circuit drives the light source to continue operate in the lighting mode associated with the second state.

In one embodiment, the mechanical switch is activated by a pushbutton in a way that partial depression of the pushbutton causes the switch to transition from the state it is in; releasing the pushbutton after partial depression but before full depression of the pushbutton causes the switch to return to the state it transitions from; and full depression of the pushbutton and thereafter releasing the pushbutton causes the switch to transition to the subsequent state.

In one embodiment, there are two first states, and so the mechanical switch cycles through the first of the first states, the second of the first states and the second state. The first of the first states is associated with a first port of the integrated circuit and a first lighting mode in which the light source is switched off. The second of the first states is associated with a second port of the integrated circuit and a second lighting mode in which the light source is switched on and provides continuous lighting. The lighting mode associated with the second state is configured to cause the light source to flash. When the integrated circuit detects that the switch is disconnected from the integrated circuit after the first of the first states and is therefore transitioning to the second of the first states, it drives the light source to operate in the second lighting mode; when the integrated circuit detects that the switch is disconnected from the integrated circuit after the second of the first states and is therefore transitioning to the second state, it drives the light source to operate in the lighting mode associated with the second state; when the switch transitions from the second state back to the first of the first states, no difference is caused to the integrated circuit as the switch is disconnected from the integrated circuit in the second state and so the integrated circuit drives the light source to continue operate in the lighting mode associated with the second state. In other embodiments, the first lighting mode may be configured to switch off the light source, the second lighting mode may be configured to cause the light source to flash, and the lighting mode associated with the second state may be configured to switch on the light source and provides continuous lighting.

In other embodiments in which there are two first states, the first lighting mode may be configured to switch on the light source to provide continuous lighting, the second light mode may be configured to switch off the light source, and the lighting mode associated with the second state may be configured to cause the light source to flash. Alternatively, the first lighting mode may be configured to cause the light source to flash, the second light mode may be configured to switch off the light source, and the lighting mode associated with the second state may be configured to switch on the light source to provide continuous lighting.

Alternatively, in other embodiments in which there are two first states, the first lighting mode may be configured to cause the light source to flash, the second lighting mode may be configured to switch on the light source to provide continuous lighting, and the lighting mode associated with the second state may be configured to switch off the light source. Alternatively, the first lighting mode may be configured to switch on the light source to provide continuous lighting, the second lighting mode may be configured to cause the light source to flash, and the lighting mode associated with the second state may be configured to switch off the light source.

The operation of the flashlight is detailed as follows: In the embodiment in which there are two first states and the first lighting mode is configured to switch off the light source, the second light mode is configured to switch on the light source and provide continuous lighting, and the lighting mode associated with the second state is configured to cause the light source to flash, when the switch is in the first of the first states initially, the switch is electrically connected to the first port of the integrated circuit and the integrated circuit drives the light source to switch off. Once the user presses the pushbutton, the switch leaves the first of the first states and is therefore disconnected from the integrated circuit. The integrated circuit detects the disconnection after the first of the first states and therefore drives the light source to operate in the second lighting mode even before the pushbutton is fully pressed. When the user presses the pushbutton fully and then releases the pushbutton, the switch is in the second of the first states and is electrically connected to the second port of the integrated circuit; the integrated circuit drives the light source to operate in the second lighting mode. In this way, the effect of a momentary switch is simulated.

When the user presses the pushbutton again, the switch leaves the second of the first states and is therefore disconnected from the integrated circuit. The integrated circuit detects the disconnection from the second of the first states and therefore drives the light source to operate in the lighting mode associated with the second state even before the pushbutton is fully pressed. When the user presses the pushbutton fully and then releases the pushbutton, the switch is in the second state and remains disconnected from the integrated circuit; the integrated circuit drives the light source to continue operate in the lighting mode associated with the second state.

When the user presses the pushbutton again, the switch leaves the second state and continues to be disconnected from the integrated circuit. The integrated circuit drives the light source to continue operate in the lighting mode associated with the second state. After the pushbutton is fully pressed and released, the switch is back to the first of the first states and is electrically connected to the first port of the integrated circuit, and the integrated circuit drives the light source to switch off accordingly.

BRIEF DESCRIPTION OF THE DRAWINGS

FIG. 1 is a circuit diagram of the present invention.

DETAILED DESCRIPTION OF THE INVENTION

The present invention is further described in detail with the following embodiment and the accompanying drawings.

As illustrated in FIG. 1, the flashlight of the present invention comprises a light source 1, a power supply 2, an integrated circuit 3 and a mechanical switch 4. In the current embodiment, the light source 1 takes the form of an LED. The power supply 2 takes the form of two 3V batteries which provide 6V in total.

The integrated circuit 3 electrically connects with the power supply 2 via port VDD and the light source 1 via port RB0. The mechanical switch 4 is activated by a pushbutton so that each depression of the pushbutton causes the switch 4 to cycle through a first state, a second state and a third state sequentially. Such pushbutton is common prior art available in the marketplace and so the structure and operation thereof is not described in detail herein. When the switch 4 is in the first state, it is electrically connected to a first port RB4 of the integrated circuit 3 and the integrated circuit 3 drives the light source 1 to operate in a first lighting mode. In this embodiment, the first lighting mode is an OFF mode in which the integrated circuit 3 drives the light source 1 to switch off. When the switch 4 is in the second state, the switch 4 is electrically connected to a second port RB5 of the integrated circuit 3 and the integrated circuit 3 drives the light source 1 to operate in a second lighting mode. In this embodiment, the second lighting mode is an ON mode in which the integrated circuit 3 drives the light source 1 to switch on and provide continuous lighting. When the switch 4 is in the third state, it is electrically disconnected from the integrated circuit 3 and the integrated circuit 3 drives the light source 1 to operate in a third lighting mode. In this embodiment, the third lighting mode is a FLASH mode in which the integrated circuit 3 drives the light source 1 to flash. When the integrated circuit 3 detects that the switch 4 is disconnected from the integrated circuit 3 after the first state and is therefore transitioning from the first state to the second state, it drives the light source 1 to operate in the lighting mode of the second state, i.e. to switch on and provide continuous lighting; when the integrated circuit 3 detects that the switch 4 is disconnected from the integrated circuit 3 after the second state and is therefore transitioning from the second state to the third state, it drives the light source 1 to operate in the lighting mode of the third state, i.e. to flash; when the switch 4 transitions from the third state back to the first state, no difference is caused to the integrated circuit 3 as the switch 4 is disconnected from the integrated circuit 3 in the third state and so the integrated circuit 3 drives the light source 1 to continue operate in the lighting mode of the third state, i.e. to continue to flash.

The operation of the flashlight is detailed as follows: Initially, when the switch 4 is in the first state, the switch 4 is electrically connected to the first port RB4 of the integrated circuit 3 and the integrated circuit 3 drives the light source 1 to switch off. Once the user presses the pushbutton, the switch 4 leaves the first state and is therefore disconnected from the integrated circuit 3. The integrated circuit 3 detects the disconnection after the first state and therefore drives the light source 1 to operate in the lighting mode of the second state, i.e. to switch on and provide continuous lighting, even before the pushbutton is fully pressed. When the user presses the pushbutton fully and then releases the pushbutton, the switch 4 is in the second state and is electrically connected to the second port RB5 of the integrated circuit 3; the integrated circuit 3 drives the light source 1 to operate in the lighting mode of the second state accordingly. In this way, the effect of a momentary switch is simulated.

When the user presses the pushbutton again, the switch 4 leaves the second state and is therefore disconnected from the integrated circuit 3. The integrated circuit 3 detects the disconnection from the second state and therefore drives the light source 1 to operate in the lighting mode of the third state, i.e. to flash, even before the pushbutton is fully pressed. When the user presses the pushbutton fully and then releases the pushbutton, the switch 4 is in the third state and remains disconnected from the integrated circuit 3; the integrated circuit 3 drives the light source 1 to continue operate in the lighting mode of the third state accordingly, i.e. to continue to flash.

When the user presses the pushbutton again, the switch 4 leaves the third state and continues to be disconnected from the integrated circuit 3. The integrated circuit 3 drives the light source 1 to continue operate in the lighting mode of the third state, i.e. to continue to flash. After the pushbutton is fully pressed and released, the switch 4 is back to the first state and is electrically connected to the first port RB4 of the integrated circuit 3, and the integrated circuit 3 drives the light source 1 to switch off accordingly.

In other embodiments, the second lighting mode may be configured to be the OFF mode, when the integrated circuit detects that the switch is disconnected from the integrated circuit after the second state and is therefore transitioning from the second state to the third state, it drives the light source to operate in the lighting mode of the third state; when the switch transitions from the third state back to the first state, no difference is caused to the integrated circuit as the switch is disconnected from the integrated circuit in the third state and so the integrated circuit drives the light source to continue operate in the lighting mode of the third state; when the integrated circuit detects that the switch is disconnected from the integrated circuit after the first state and is therefore transitioning from the first state to the second state, it drives the light source to operate in the lighting mode of the first state.

The above embodiments are preferred embodiments of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A flashlight with momentary function and multiple lighting modes comprising a light source;

a power supply;

an integrated circuit electrically connected with the power supply and the light source; and a mechanical switch activated by a pushbutton so that each depression of the pushbutton causes the switch to cycle through a first state, a second state and a third state sequentially; when the switch is in the first state, it is electrically connected to a first port of the integrated circuit and the integrated circuit drives the light source to operate in a first lighting mode; when the switch is in the second state, the switch is electrically connected to a second port of the integrated circuit and the integrated circuit drives the light source to operate in a second lighting mode; when the switch is in the third state, it is electrically disconnected from the integrated circuit and the integrated circuit drives the light source to operate in a third lighting mode; either the first lighting mode or the second lighting mode is configured to be an OFF mode in which the integrated circuit drives the light source to switch off; when the integrated circuit detects that the switch is disconnected from the integrated circuit after a state which corresponds to the OFF mode and is therefore transitioning to a subsequent state, it drives the light source to operate in the lighting mode of the subsequent state.

2. A flashlight with momentary function and multiple lighting modes as in claim 1, wherein the first lighting mode is configured to be the OFF mode, and when the integrated circuit detects that the switch is disconnected from the integrated circuit after the first state and is therefore transitioning from the first state to the second state, it drives the light source to operate in the lighting mode of the second state; when the integrated circuit detects that the switch is disconnected from the integrated circuit after the second state and is therefore transitioning from the second state to the third state, it drives the light source to operate in the lighting mode of the third state; when the switch transitions from the third state back to the first state, no difference is caused to the integrated circuit as the switch is disconnected from the integrated circuit in the third state and so the integrated circuit drives the light source to continue operate in the lighting mode of the third state.

3. A flashlight with momentary function and multiple lighting modes as in claim 2, wherein the integrated circuit drives the light source to switch off in the first state, to switch on and provide continuous lighting in the second state and to flash in the third state.

4. A flashlight with momentary function and multiple lighting modes as in claim 1, wherein the second lighting mode is configured to be the OFF mode, and when the integrated circuit detects that the switch is disconnected from the integrated circuit after the second state and is therefore transitioning from the second state to the third state, it drives the light source to operate in the lighting mode of the third state; when the switch transitions from the third state back to the first state, no difference is caused to the integrated circuit as the switch is disconnected from the integrated circuit in the third state and so the integrated circuit drives the light source to continue operate in the lighting mode of the third state; when the integrated circuit detects that the switch is disconnected from the integrated circuit after the first state and is therefore transitioning from the first state to the second state, it drives the light source to operate in the lighting mode of the first state.

5. A flashlight with momentary function and multiple lighting modes as in claim 4, wherein the integrated circuit drives the light source to switch off in the second state, to switch on and provide continuous lighting in the third state and to flash in the first state.

* * * * *